United States Patent [19]

Duncan

[11] Patent Number: 4,616,975

[45] Date of Patent: Oct. 14, 1986

[54] DIAPHRAGM FOR A STEAM TURBINE

[75] Inventor: Dan Duncan, Schenectady, N.Y.

[73] Assignee: General Electric Company, Schenectady, N.Y.

[21] Appl. No.: 635,948

[22] Filed: Jul. 30, 1984

[51] Int. Cl.[4] ..... T01D 5/10

[52] U.S. Cl. ..... 415/181; 415/185; 415/189

[58] Field of Search ..... 415/181, 183, 189, 217, 415/185, 187

[56] References Cited

U.S. PATENT DOCUMENTS

| | | | |
|---|---|---|---|
| 2,805,818 | 9/1957 | Ferri | 415/181 |
| 2,935,246 | 5/1960 | Roy | 415/191 |
| 2,974,858 | 3/1961 | Koffel et al. | 415/181 |
| 2,974,927 | 3/1961 | Johnson | 415/181 |
| 3,565,548 | 2/1971 | Fowler et al. | 416/235 |

FOREIGN PATENT DOCUMENTS

| | | | |
|---|---|---|---|
| 2451453 | 3/1980 | France | 415/181 |
| 918522 | 2/1963 | United Kingdom | 415/217 |
| 1522594 | 8/1978 | United Kingdom | 415/181 |

*Primary Examiner*—Robert E. Garrett
*Assistant Examiner*—John Kwon
*Attorney, Agent, or Firm*—Paul Checkovich; Jerome C. Squillaro

[57] ABSTRACT

A diaphragm for an axial flow turbine includes a plurality of spaced apart nozzle partitions and an inner member for fixedly securing the nozzle partitions. The inner member is contoured to direct elastic fluid flow radially inward. The nozzle partitions are spaced such that a minimum throat extends a predetermined radial distance from the root, thereby forming a converging-diverging flow passageway between nozzle partitions. The trailing edge of the nozzle partitions are disposed to include axial and tangential lean with respect to the rotor of the turbine.

11 Claims, 6 Drawing Figures

DIAPHRAGM FOR A STEAM TURBINE

BACKGROUND OF THE INVENTION

This invention relates generally to an improved diaphragm of an axial flow turbine using an elastic fluid, such as steam, and more particularly to control of supersonic transitions and flow of elastic fluid through the diaphragm.

A diaphragm of an axial flow turbine typically comprises an inner and an outer circumferential ring and a plurality of spaced apart nozzle partitions for forming elastic fluid flow passages therebetween. Each nozzle partition includes an end respectively fixedly secured to the inner and outer ring, respectively, of the diaphragm. In operation, the outer ring is generally fixedly mounted to the inner shell of the turbine and the inner ring is spaced from and surrounds the rotor of the turbine. Typically, some type of seal, such as labyrinth seals known in the art, are disposed between the inner ring of the diaphragm and the rotor of the turbine. Nozzle partitions control and direct flow of elastic fluid into energy extracting means, such as turbine blades or buckets, and a cooperating combination including a diaphragm and a plurality of buckets is commonly referred to as a stage.

In order to obtain maximum power from energy available from the elastic fluid, it is necessary that the flow of elastic fluid be precisely controlled. The flow of elastic fluid must impinge the energy extracting means at a predetermined optimum angle and the optimum elastic fluid flow distribution from the radial inner portion or root of the nozzle partition to the radial outer portion or tip of the nozzle partition must be maintained and efficiently accommodate a broad range of operating conditions, such as elastic fluid mass flow rate variations and stage output pressure variations, which may be expected, especially for the last stage of a low pressure turbine.

It is possible to obtain supersonic steam flow through passages between nozzle partitions of a diaphragm in a steam turbine, especially at the root (radially inner portion) of the last stage of a low pressure turbine, and the transition or transonic region from subsonic to supersonic flow must be controlled to ensure that desired steam flow conditions, such as minimizing oblique shocks to minimize efficiency loss resulting therefrom, are maintained throughout the stage from the input of the nozzle partitions to the input of the buckets and ultimately to the input of the next stage or a condenser if the steam output from the buckets is from the last stage. An improper or unexpected transonic region through passages between nozzle partitions may result in a loss of efficiency due to undesirable shock patterns. A transition from subsonic to supersonic flow is accompanied by a shock wave which causes an irreversible loss of pressure, i.e., pressure is lost and cannot be recovered to produce mechanical energy. It is especially worthwhile to ensure that operation of the last stage of a low-pressure steam turbine yields optimum stage (and thereby optimum diaphragm) efficiency since the last stage of a low pressure turbine recovers substantially more energy, typically about 10% of the overall turbine output, from steam than any other stage in the turbine and thus has a significant impact on overall efficiency of the turbine.

Natural forces, such as those due to rotation of turbine components, tend to direct steam flow radially outward, away from the inner portion or root of buckets, thereby creating flow separation and potential starvation at the root of buckets. It would be desirable to redirect at least some steam flow radially inward in order to delay onset of flow separation and starvation.

It is an object of the present invention to provide a diaphragm for an axial flow turbine for controlling transonic flow of elastic fluid through the diaphragm.

Another object is to provide a diaphragm for maintaining desired radial flow distribution of elastic fluid through the diaphragm and at the output of the diaphragm over a range of operating conditions.

Yet another object is to provide a diaphragm for directing a proportionally greater amount of elastic fluid flow radially inwardly to minimize bucket root starvation and to delay onset of flow separation and recirculation.

SUMMARY OF THE INVENTION

In accordance with the present invention, a diaphragm of an axial flow turbine comprises a plurality of spaced apart nozzle partitions forming a respective plurality of channels therebetween and an inner member for fixedly securing the plurality of nozzle partitions, each of the partitions including both an axial and a tangential lean of the trailing edge, the axial and tangential lean each with respect to a radial reference from the axis of rotation of a rotor about which the diaphragm is adapted to operate. The inner member includes a greater outward radial extent proximate the leading edge of nozzle partitions than the outward radial extent proximate the trailing edge of nozzle partitions. Each of the plurality of nozzle partitions is spaced from an adjacent nozzle partition such that the channel therebetween includes a minimum throat and a trailing edge throat, wherein the minimum throat is disposed between the leading edge of the nozzle partition and the trailing edge throat at the root of the nozzle partition and the minimum throat is disposed monotonically more proximate the trailing edge throat of the nozzle partition at increasing radial distance from the root of the nozzle partition, whereby the margins of the channel define a converging-diverging passageway at least over a portion of the radial extent of the channel.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
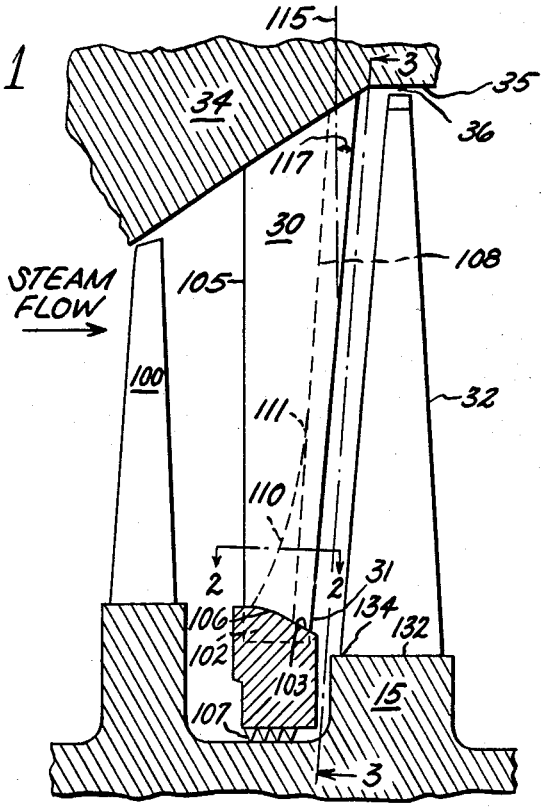
FIG. 1 is a tangential view of a diaphragm in accordance with the present invention.

Referring to FIG. 1, a tangential view of a diaphragm 105 in accordance with the present invention is shown. Also illustrated is a representative bucket 32 from the stage of the turbine associated with diaphragm 105 and a representative bucket 100 from the next preceeding upstream stage of the turbine.

Diaphragm 105 comprises a nozzle partition 30, including a leading edge 104, and an inner diaphragm ring 102 for fixedly retaining the root of nozzle partition 30. The outer portion or tip of nozzle partition 30 is fixedly secured to shell 34. Trailing edge 31 of nozzle partition 30 is axially leaned so that the radially outermost portion of trailing edge 31 is axially further downstream than the radially innermost portion of trailing edge 31. That is, trailing edge 31 of nozzle partition is skewed with respect to a radial axis 115 of a shaft 15 of a turbine by an angle 117. Angle 117 is preferably less than about 5°.

Figure 2:
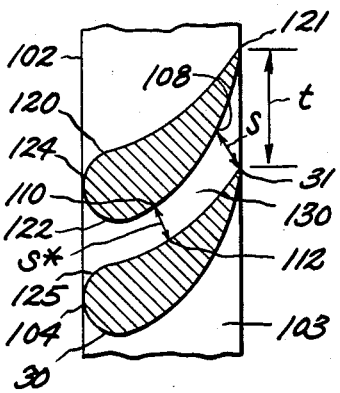
FIG. 2 is a radially inward view looking in the direction of line 2—2 of FIG. 1.

Referring to FIG. 2, a radially inward view taken along line 2—2 of FIG. 1 is shown. Nozzle partition 30 and an adjacent nozzle partition 120 are identified. For convenience and ease of understanding, only two nozzle partitions are shown. It is to be understood that a plurality of nozzle partitions respectively having the same relative disposition as nozzle partitions 30 and 120, respectively, are disposed in diaphragm 105 (FIG. 1) and circumferentially surround shaft 15 (FIG. 1).

Trailing edge 31 of nozzle partition 30 and a corresponding trailing edge 121 of nozzle partition 120 appear as a point in FIG. 2. The distance between trailing edge 31 and trailing edge 121 is the pitch of the nozzle partitions and is designated by the letter t. The distance from trailing edge 31 of nozzle partition 30 to the closest point 108 on the suction surface 122 of nozzle partition 120 is called the exit or trailing edge throat and is designated by the letter s.

In order to control supersonic flow through a channel 130 between nozzle partitions 30 and 120, it is necessary for channel 130 to decrease in flow area from the upstream entrance (between leading edges 104 and 124 of nozzle partitions 30 and 120, respectively) of channel 130 to a minimum flow area disposed between the upstream entrance and downstream exit (between trailing edges 31 and 121 of nozzle partitions 30 and 120, respectively) of channel 130 and then to increase in flow area from the location of the minimum flow area to the downstream exit of channel 130, thus forming a converging-diverging flow path through channel 130. Minimum flow area through channel 130 occurs at the minimum throat where, for example, the distance from a point 110 on suction surface 122 of nozzle partition 120 to a point 112 on pressure surface 125 of nozzle partition 30 is minimum and is indicated by the symbol s*. It is also common practice to indicate flow areas rather than distances and in such case the symbols s and s* are replaced by A and A* respectively. The ratio s/t as a function of radial distance from the root of a nozzle partition is also commonly used to define the spatial relationship between adjacent nozzle partitions.

Returning to FIG. 1, the locus of points 108 on nozzle partition 120 defining the exit throat on suction surface 122 of nozzle partition 120 between nozzle partitions 30 and 120 (FIG. 2) is shown. Also indicated is the locus of points 110 on nozzle partition 120 defining the minimum throat between nozzle partition 30 and 120 (FIG. 2). A corresponding locus of points 112 (FIG. 2) on pressure surface 125 of nozzle partition 30 is not shown in FIG. 1 for maintaining clarity. It is noted that locus 110 of the minimum throat commences downstream of leading edge 104 of nozzle partition 30 and upstream of the locus of points 108 at the root of nozzle partition 30. Locus 110 of the minimum throat between nozzle partitions 30 and 120 (FIG. 2) is monotonically disposed further downstream or closer to locus 108 for increasing radial distance from the root of nozzle partition 30 until locus 110 merges with locus 108, i.e., minimum throat s* occurs coincident with and is equal to exit throat s, at a predetermined point 111 intermediate the root and tip of nozzle partition 30. The outward radial extent from the root of nozzle partition 30 of the point of merger 111 between locus 108 and locus 110 is determined by the amount of control of supersonic flow which is desired. Typically, the velocity profile through channel 130 (FIG. 2) is such that the greatest velocity of steam flow occurs at the root with the velocity decreasing in steam flow radially removed from the root toward the tip of nozzle partition 30. It is necessary to control the direction and occurrence of supersonic shocks in order to maintain optimum efficiency. Undesired or unexpected shocks may accompany distorted steam flow through channel 130 (FIG. 2) and thus present off optimal steam conditions to the input of bucket 32 resulting in decreased stage efficiency.

The radially outer surface or periphery 103 of inner ring 102 of diaphragm 105 is contoured for controlling and directing steam flow toward the root 132 of bucket 32. From leading edge 104 of nozzle partition 30 to a point 106 on periphery 103 of inner ring 102, the profile of surface 103 of inner ring 102, the profile of surface 103 is preferably an arc of a circle having a predetermined radius. Thus, the contour of surface 103 of inner ring 102 from leading edge 104 of nozzle partition 30 to point 106 defines a partial surface of a torus or doughnut circumferentially around periphery 103. The locus of points 106 around inner ring 102 is a circle disposed intermediate minimum throat margin 110 and exit throat margin 108.

From point 106 to trailing edge 31 of nozzle partition 30, the profile of surface 103 is preferably a straight line which if extended would intersect at juncture 134 of leading edge 136 and root 132 of bucket 32. Thus the contour of surface 103 of inner ring 102 from point 106 to trailing edge 31 of nozzle partition 30 defines the surface of a truncated cone circumferentially around periphery 103. Of course other shapes and contours of periphery 103 effective for controlling and directing steam flow radially inward toward the root of an associated bucket may be used.

Figure 4A:
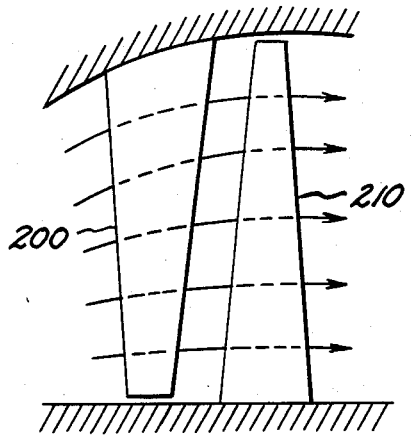
FIGS. 4*a* and 4*b* are simplified stage diagrams of an axial flow turbine showing fluid flow through the stage.
Figure 4B:
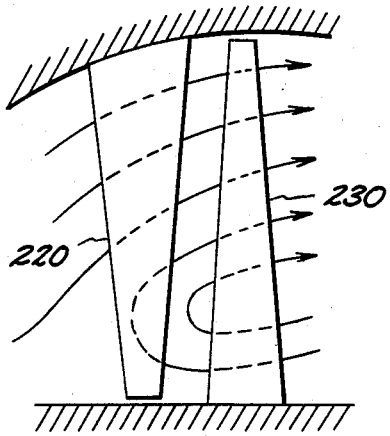

Referring to FIGS. 4*a* and 4*b*, steam flow through a simplified stage is shown. In FIG. 4*a*, a desired steam flow, indicated by flow lines with arrowheads, for obtaining optimum efficiency is shown. Steam, which is generally expanding, from the adjacent upstream stage (not shown) is directed in accordance with the present invention by a nozzle partition 200 to enter a bucket 210 and exits bucket 210 in a substantially axial direction. In FIG. 4*b*, an undesirable steam flow, indicated by flow lines with arrowheads, is shown.

The last stage of a steam turbine, especially a low pressure turbine, must be capable of operation with a variable exhaust volume flow of steam, typically expressed as a function of the average axial annulus velocity $V_{ax}$, while minimizing the effects of such variation on efficiency. Variations in exhaust volume flow of steam occur due to fluctuations in power output generated by the turbine, since steam mass flow through the last stage varies approximately linearly with the output power of the turbine, and due to exhaust pressure variations, since exhaust pressure for a typical turbine operating environment is not constant. Exhaust pressure from a turbine is a function of condenser design and operating conditions and is primarily affected by temperature of cooling water input to the condenser. Generally a large quantity of water is required for cooling and typically it may be supplied from a source exposed to the weather which accordingly experiences temperature shifts over a year due to seasonal changes.

During normal turbine operation at a load within from about 40% to about 100% of optimum output design load for the turbine, steam flow through the last stage should be similar to that shown in FIG. 4*a*. When steam flow through the last stage is reduced and/or when exhaust pressure of the stage is increased, a radially outward component of velocity is imparted to the steam flow, especially at the bucket, which may cause flow separation or flow starvation (i.e., inadequate flow for optimum efficiency) starting at the root of the bucket and ultimately may result in a recirculating steam flow pattern as shown in FIG. 4*b*. Recirculating flow is undesirable and must be avoided since it causes a large decrease in efficiency. In one aspect of the present invention, features of the diaphragm, including nozzle partitions, and of buckets coact to delay onset of such recirculating flow thus permitting maximal efficiency operation over a wider range of steam flow and exhaust pressure conditions than do conventional stage designs.

Figure 5:
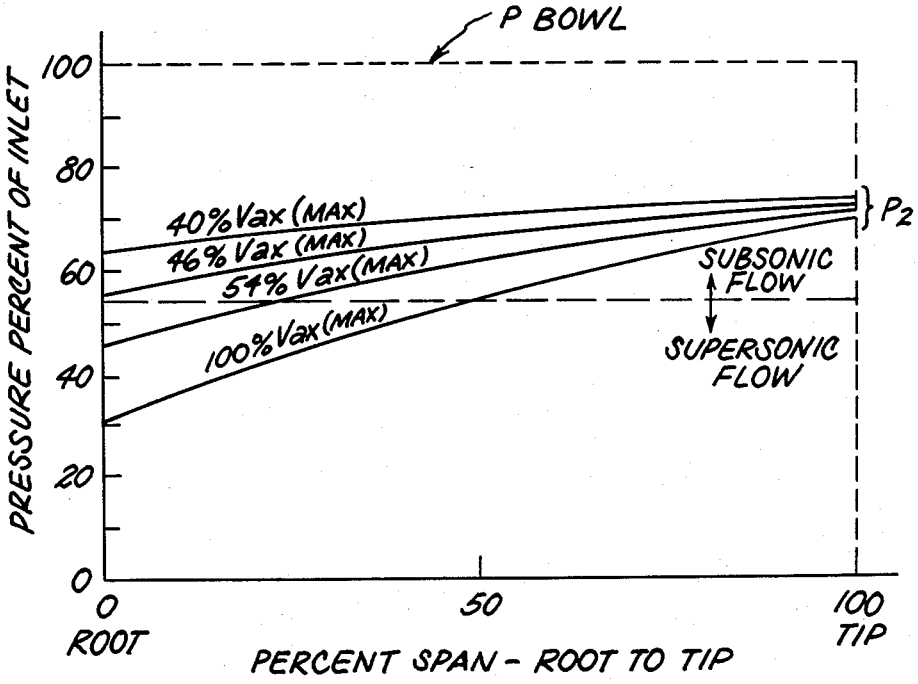
FIG. 5 is a representative graph of pressure characteristics across a nozzle partition in accordance with the present invention.

Referring to FIG. 5, representative pressure operating characteristics of a last stage in accordance with the present invention are shown. The ordinate represents nozzle partition exit pressure $P_2$ relative to nozzle partition inlet pressure. Nozzle partition inlet pressure is nominally the output pressure from the next preceeding upstream stage of the turbine and is commonly designated $P_{BOWL}$. The abscissa represents the percent of radial span from the root (closest to shaft) to the tip (closest to shell) of a nozzle partition. When the ratio of the input pressure to the output pressure across a nozzle partition at a predetermined radial location on the nozzle partition is greater than about 1.83 then a transonic (i.e., subsonic to supersonic) flow region will occur within the flow channel defined by the nozzle partition at the predetermined radial location. The boundary for transonic flow is indicated in FIG. 5 and intercepts the ordinate at a value of about 54.6% (i.e. $P_{BOWL}/P_2=1.83$ or $P_2=0.546P_{BOWL}$). Legends on the curves of FIG. 5 are representative of typical values of average axial annulus velocity $V_{ax}$ as a percentage of the maximum or design average axial annulus velocity $V_{ax}$(max) which may be encountered during turbine operation.

As is shown in FIG. 5, for $V_{ax}=V_{ax}$(max), there is a relatively large difference (i.e. about 37% $P_{BOWL}$) in pressure $P_2$ between the tip (about 68% $P_{BOWL}$) and the root (about 31% $P_{BOWL}$) of a nozzle partition. This pressure difference is counterbalanced by the inertia force of the flow with a high tangential velocity between nozzle partition and bucket. When $V_{ax}$ is decreased, say for example $V_{ax}=40\%$ $V_{ax}$(max) the difference (about 8% $P_{BOWL}$) in pressure $P_2$ between root (about 64% $P_{BOWL}$) and tip (about 72% $P_{BOWL}$) substantially decreases. Inertial forces of flow between nozzle partitions and buckets also decrease when $V_{ax}$ is decreased, but not as rapidly as does the difference in pressure between root and tip of the nozzle partition for an equivalent decrease in $V_{ax}$. Ultimately, $V_{ax}$ may be decreased to a value at and below which steam flow cannot completely fill the steam path and then recirculating flow, as hereinbefore described, may occur.

Coaction of nozzle partition 30 (FIG. 1) and bucket 32 (FIG. 1) in accordance with the present invention increases acceptable operating range of exhaust pressure and steam flow in the turbine to delay onset of flow recirculation. The acceptable ranges are increased by imparting to steam flowing between a region of nozzle partitions, wherein the region extends from the root to a predetermined radial distance from the root, a predetermined inward radial component of velocity or momentum.

The imparted inward radial component of momentum opposes inertial forces of steam flow generated by tangential velocity of steam flow which opposition causes an effective reduction in the magnitude of the inertial forces, thereby delaying onset of root flow separation and recirculating flow at the bucket.

Figure 3:
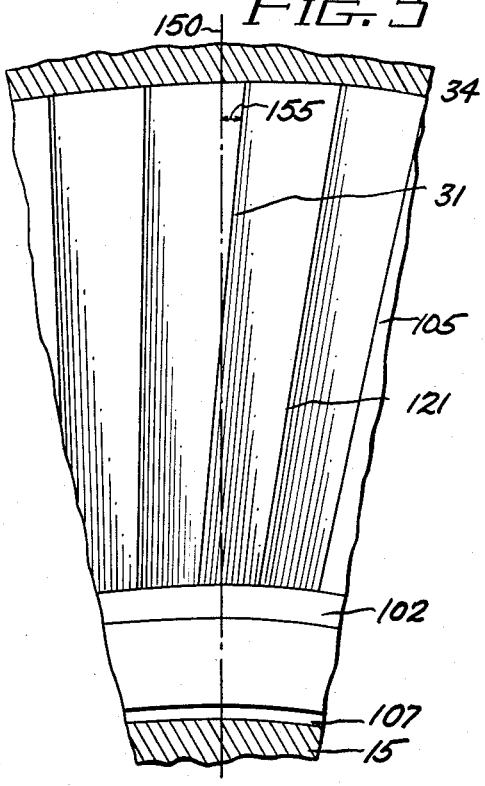
FIG. 3 is a view looking in the direction of line 3—3 of FIG. 1.

Referring to FIG. 3, a partial view (not to scale) taken along line 3—3 of FIG. 1 is shown. It is to be understood that diaphragm 105 extends circumferentially entirely around shaft 15. Trailing edge 31 of nozzle partition 30 and trailing edge 121 (FIG. 2) of nozzle partition 120 (FIG. 2) are identified and are representative of the purality of nozzle partitions circumferentially surrounding shaft 15. A reference line 150 radially extends through the axis of rotation of shaft 15. Trailing edge 31 is tangentially skewed or leaned with respect to reference line 150. Angle 155 between reference line 150 and trailing edge 31 of nozzle partition 30 is preferably less than about 12°. Thus, in one aspect of the present invention, axial and tangential lean of nozzle partitions 30 and 120, inner wall contouring of inner ring 102 of diaphragm 105 and positioning of minimum throat and s* (FIG. 2) between nozzle partitions 30 and 120 coact to delay onset of recirculating flow through the stage, thus permitting maximal efficiency over a wider range of steam flow conditions and exhaust pressure changes than do conventional diaphragm designs.

Thus has been illustrated and described a diaphragm providing control of transonic flow of elastic fluid through the diaphragm. Further, positioning a transonic elastic fluid flow region to delay onset of recirculating flow has been shown and described. In addition, a diaphragm for maintaining desired radial flow distribution and for directing a proportionately greater amount of elastic fluid flow radially inwardly to minimize bucket root starvation and to delay onset of flow separation and recirculation has been illustrated and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A diaphragm of an axial flow turbine, said turbine including a rotor and energy extracting means coupled to said rotor for converting at least a portion of energy available from an elastic fluid into mechanical energy, said diaphragm for circumferential disposition around the rotor for directing said elastic fluid into said energy extracting means, comprising:

a plurality of spaced apart nozzle partitions forming a respective plurality of channels therebetween; and an inner member for fixedly securing said plurality of nozzle partitions, each of said plurality of nozzle partitions having a root portion proximate the inner member and including a leading edge and a trailing edge and disposed to include both an axial lean and a tangential lean of the trailing edge, each of said axial lean and said tangential lean with respect to a radial reference from the axis of rotation of the rotor, said inner member including a greater outward radial extent proximate the leading edge of the nozzle partitions than the outward radial extent proximate the trailing edge of the nozzle partitions;

each of said plurality of nozzle partitions spaced from an adjacent nozzle partition such that the channel therebetween includes a minimum throat and a trailing edge throat, wherein the minimum throat is disposed between the leading edge of the nozzle partition and the trailing edge throat at the root of the nozzle partition and the minimum throat is disposed monotonically more proximate the trailing edge throat of the nozzle partition at increasing radial distance from the root of said nozzle partition, whereby the margins of the channel define a converging-diverging passageway at least over a portion of the radial extent of the channel.

2. The diaphragm as in claim 1 wherein said axial lean is less than about 5 degrees.

3. The diaphragm as in claim 1 wherein said tangential lean is less than about 12 degrees.

4. The diaphragm as in claim 1 wherein said minimum throat merges with said trailing edge throat at a predetermined radial distance intermediate the tip and the root of the nozzle partition.

5. The diaphragm as in claim 1 wherein the outward radial extent of said inner member proximate the leading edge of the nozzle partitions to a predetermined axial location intermediate said minimum throat and said trailing edge throat at the root of the nozzle partitions defines an arc of a torus wherein the outward radial extent of said inner member is greater proximate the leading edge of the nozzle partitions than at said predetermined location point and wherein the outward radial extent of said inner member from said predetermined axial location to the portion of said inner member proximate the trailing edge of the nozzle partitions defines a truncated conical section.

6. An axial flow turbine including a rotor and energy extracting means coupled to said rotor for converting at least a portion of energy available from an elastic fluid into mechanical energy, comprising:

a diaphragm for circumferential disposition around the rotor for directing at least a portion of said elastic fluid into said energy extracting means, said diaphragm including:

a plurality of spaced apart nozzle partitions forming a respective plurality of channels therebetween; and an inner member for fixedly securing said plurality of nozzle partitions, each of said plurality of nozzle partitions having a root portion proximate the inner member and including a leading edge and a trailing edge and disposed to include both an axial lean and a tangential lean of the trailing edge, each of said axial lean and said tangential lean with respect to a radial reference from the axis of rotation of the rotor, said inner member including a greater outward radial extent proximate the leading edge of the nozzle partitions than the outward radial extent proximate the trailing edge of the nozzle partitions;

each of said plurality of nozzle partitions spaced from an adjacent nozzle partition such that the channel therebetween includes a minimum throat and a trailing edge throat, wherein the minimum throat is disposed between the leading edge of the nozzle partition and the trailing edge throat at the root of the nozzle position and the minimum throat is disposed monotonically more proximate the trailing edge throat of the nozzle partition at increasing radial distance from the root of said nozzle partition, whereby the margins of the channel define a converging-diverging passageway at least over a portion of the radial extent of the channel.

7: The turbine as in claim 6 wherein said axial lean is less than about 5 degrees.

8. The turbine as in claim 6 wherein said tangential lean is less than about 12 degrees.

9. The turbine as in claim 6 wherein said minimum throat merges with said trailing edge throat at a predetermined radial distance intermediate the tip and the root of the nozzle partition.

10. The turbine as in claim 6 wherein the outward radial extent of said inner member proximate the leading edge of the nozzle partitions to a predetermined axial location intermediate said minimum throat and said trailing edge throat at the root of the nozzle partitions defines an arc of a torus wherein the outward radial extent of said inner member is greater proximate the leading edge of the nozzle partitions than at said predetermined axial location and wherein the outward radial extent of said inner member from said predetermined axial location to the portion of said inner member proximate the trailing edge of the nozzle partitions defines a truncated conical section.

11. The turbine as in claim 10 wherein said energy extracting means comprises a plurality of buckets, said buckets being circumferentially disposed around said rotor and being disposed axially downstream from said diaphragm, and an extension of the conical section intercepts said plurality of buckets at the intersection of the leading edge and root of the plurality of buckets.

* * * * *